United States Patent [19]

Goldberg et al.

[11] Patent Number: 4,474,302

[45] Date of Patent: Oct. 2, 1984

[54] SAFETY CHAMPAGNE CORK

[75] Inventors: James R. Goldberg, 315 Grandview Ave., Novato, Calif. 94947; Albert J. Kurtz, Marshall, Calif.

[73] Assignee: James R. Goldberg, Novato, Calif.

[21] Appl. No.: 548,313

[22] Filed: Nov. 3, 1983

[51] Int. Cl.[3] ..... B65D 41/34; B65D 41/48

[52] U.S. Cl. ..... 215/256; 215/258; 215/306

[58] Field of Search ..... 215/256, 258, 306; 220/270, 375

[56] References Cited

U.S. PATENT DOCUMENTS 773,345 10/1904 Scheidt .
2,265,263 5/1918 Sharpe .
3,235,117 2/1966 Mason, Jr. .
3,994,409 11/1976 Nightengale .

*Primary Examiner*—George T. Hall

*Attorney, Agent, or Firm*—Fitch, Even, Tabin & Flannery

[57] ABSTRACT

A molded tethered safety closure device for use on bottles containing pressurized liquids such as champagne or sparkling wines comprising a cork or closure element and a retainer collar joined by an intercoupling section. The intercoupling section is comprised of a tabbed tear strip and a tether strip that are integrally formed in a helical configuration extending in a plurality of turns from the cork to the collar. The tether strip and the tear strip are interconnected by a pair of grooved frangible webs that can be torn by pulling on the tear strip. This allows the tear strip to be manually removed from the intercoupling section. Following removal of the tear strip, the helical tether strip interconnects the cork and the retainer collar, thus enabling the cork to be released from the bottle without flying free.

9 Claims, 4 Drawing Figures

FIG. 1
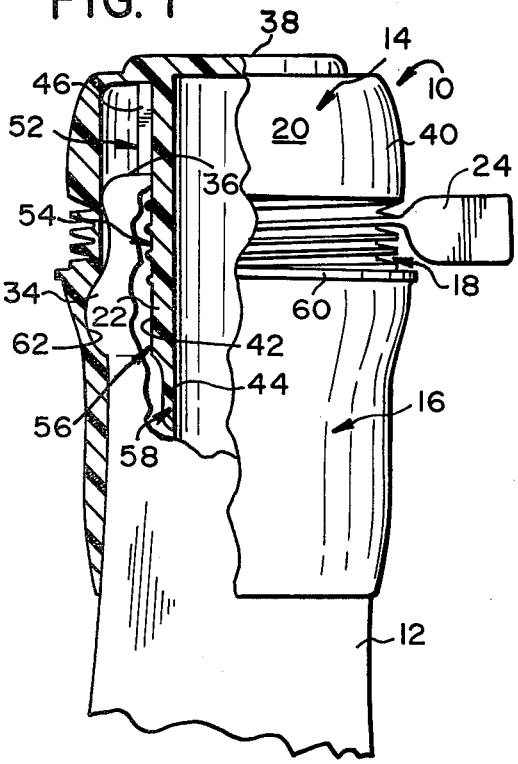
FIG. 4
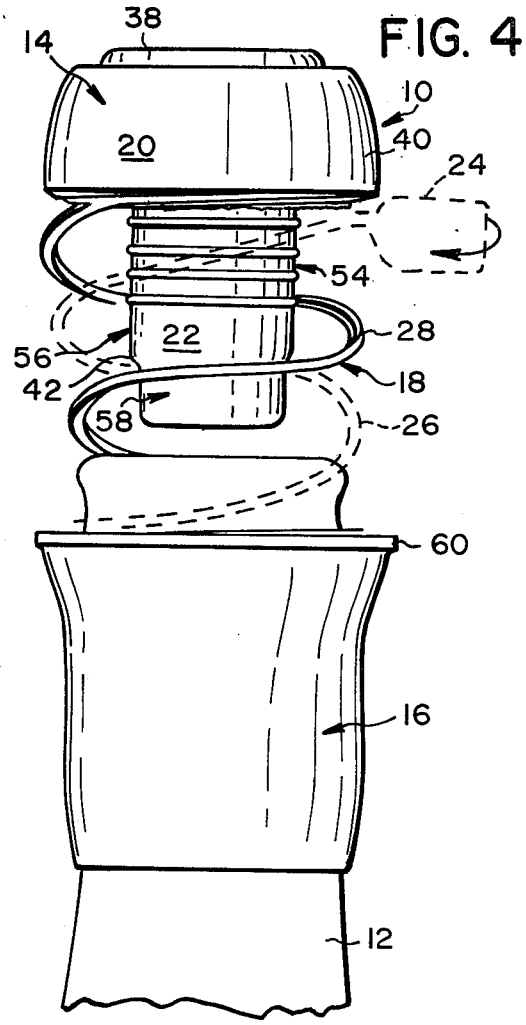
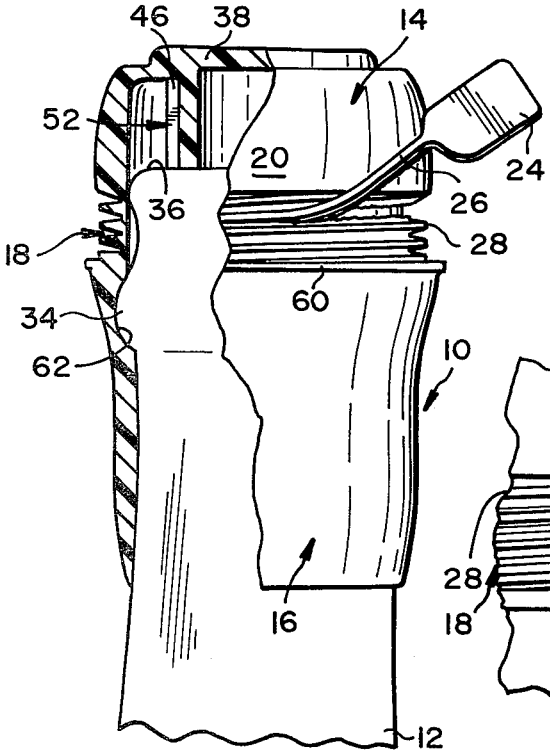
FIG. 2
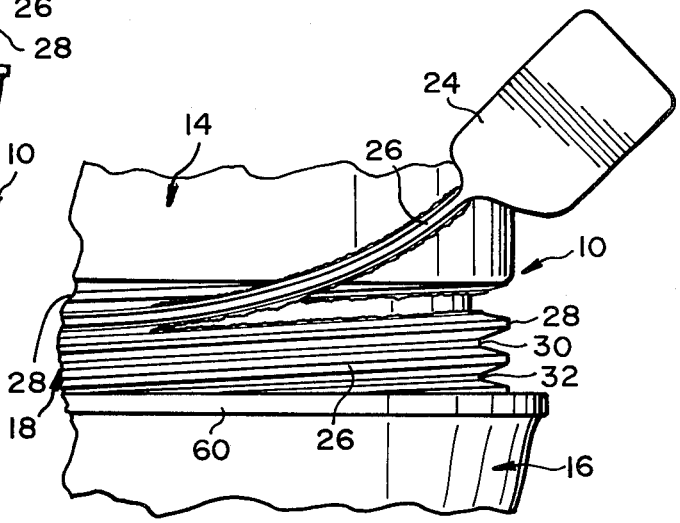
FIG. 3

SAFETY CHAMPAGNE CORK

BACKGROUND OF THE INVENTION

This invention relates generally to closure devices and more specifically to a safety closure device for use on bottles containing pressurized beverages such as champagne or sparkling wines.

The drinking of champagne or sparkling wine is usually associated with happiness and frivolity. Unfortunately this happiness and frivolity has all too often ended in tragedy because of injuries caused by flying corks. Because of pressure inside a bottle of champagne or sparkling wine, particularly if the wine has been shaken or is warmer than recommended, a cork can be propelled from the bottle at a velocity of well over 100 mph. Unattentive individuals opening the bottle or persons standing nearby can be seriously injured by these flying corks.

Since the shape of a champagne cork is compatible with the adult eye socket, injuries resulting from flying champagne corks are typically eye associated. Severe eye damage, or even complete loss of eyesight, can result from these accidents. Of course, other injuries are possible, such as injuries to teeth, or damage to adjacent property such as glasses or windows.

The problem of premature or inadvertent explosive release of champagne corks is exacerbated by the fact that many lower priced champagnes and sparkling wines are closed by molded plastic corks. Such plastic corks possess an even greater tendency than natural corks to become dislodged as a result of internal pressure in the bottle. In addition, the slipperiness of plastic is sometimes increased when the cork is molded because of a residue of the release agents often used to facilitate removal of a hot plastic cork from the mold in which it is made. Wetness on the glass surface of the bottle as a result of condensation or seepage of the contents can also reduce friction between the surface of the glass and the surface of the plastic cork.

Bottlers of champagne and sparkling wines have utilized a variety of techniques to prevent inadvertent release of corks from bottles. These techniques have included the employment of wire and plastic wrappings and metal restraining devices, most of which are complex, expensive, and require care in their removal. Moreover, with nearly all of these devices, once the restraining device has been removed, the cork is free to fly out of the bottle if it is not manually restrained. Although many champagne bottlers now include "flying cork" warning notices and restraining device removal instructions on their labels, unfortunately, in situations where champagne and sparkling wines are typically used, it is not always reasonable to expect the exercise of care and caution that is required to avoid injury.

Various types of tethers for bottle stoppers are well known in the prior art. Examples of these are shown in U.S. Pat. No. 773,345 (1904), U.S. Pat. No. 1,265,263 (1918) and U.S. Pat. No. 3,235,117 (1966). Moreover, the use of tear strips in molded closures in order to form integral tethers is also well known (see for example, U.S. Pat. No. 3,994,409 (1976)). Although the foregoing patents and other prior art may be satisfactory for certain types of closures, the peculiar characteristics of containers with pressurized ingredients, such as champagne and sparkling wines, make prior art efforts unsuitable. This is because of the need for a closure device in which the tether is always attached to the cork while also permitting the manipulation necessary to extricate the cork from the bottle. Ironically, especially if the champagne is properly chilled and therefore at reduced pressure, removal of the cork is sometimes difficult.

It is an object of the present invention to provide an improved closure device for a bottle or the like which is particularly well suited for use in connection with champagne and sparkling wines.

It is another object of this invention to provide a safety closure device for bottles containing pressurized liquids such as champagne or sparkling wines.

It is a another object of this invention to provide a tethered safety closure device for use on bottles containing pressurized liquids such as champagne or sparkling wines which will enable the cork to be easily released from the bottle but which will restrain the cork from flying free.

It is another object of this invention to provide a safety closure device for champagne or sparkling wine that eliminates the need for secondary applications of additional restraining devices such as wire baskets, shrink wraps or other retainer devices.

It is a further object of this invention to provide a safety cork device that eliminates the need to manually restrain the champagne cork as it is being removed from the bottle.

It is a still further object of this invention to provide a safety cork device incorporating a tamperproof safety seal that unmistakeably indicates when the seal has been tampered with.

Other objects of the invention will become apparent from the following description and drawings.

BRIEF DESCRIPTION OF THE DRAWINGS

FIG. 1 is a partially sectional side view of a safety closure device of the present invention;

FIG. 2 is a partially sectional side view of the device of FIG. 1 illustrating partial removal of a tabbed tear strip;

FIG. 3 is a partially sectional side view of an intercoupling means on the device of FIG. 1 further illustrating partial removal of a tabbed tear strip; and FIG. 4 is a side view of the safety closure device of the present invention showing the device as it appears following removal of the tabbed tear strip and release of the cork.

SUMMARY OF THE INVENTION

Very generally the tethered safety closure device of the present invention, for use on bottles containing pressurized liquids such as champagne or sparkling wines, comprises a cork or closure element and a retainer collar joined by an intercoupling means. The intercoupling means is comprised of a tabbed tear strip and a tether strip that are integrally formed in a helical configuration extending in a plurality of turns from the cork or closure element to the collar. The tether strip and the tear strip are interconnected by a pair of grooved frangible webs of a thickness preselected to permit the tear strip to be manually removed by pulling on the tabbed end. When the tear strip is removed, the helical tether strip interconnects the cork and the retainer collar thus enabling the cork to be released from the bottle without flying free.

DESCRIPTION OF THE PREFERRED EMBODIMENT

The presently preferred embodiment of the present invention is illustrated in FIGS. 1–4. A preferred tethered safety closure device 10 is shown mounted on the neck of a bottle 12 designed to hold pressurized liquids such as champagne or other sparkling wines. The tethered safety closure device 10 includes a cork or closure element 14 and a retainer collar 16 connected by an intercoupling means 18.

Element 14 is adapted to close the mouth of a bottle or the like by frictional engagement with the interior facing surface of the mouth. Element 14 is further comprised of a cup-like cap 20 and an inner plug 22. The intercoupling means 18 is further comprised of a tabbed 24 tear strip 26 and a tether strip 28 that are integrally formed in a helical configuration extending in a plurality of turns from element 14 to collar 16. The tether strip 28 and the tear strip 26 are interconnected by a pair of grooved frangible webs 30 and 32. The thickness of the pair of grooved frangible webs is preselected to be less than the thickness of the tether and tear strips. Tear strip 26 also contains an integral pull tab portion 24 which provides an easy and convenient means for grasping tear strip 26 prior to its removal.

When pull tab portion 24 of tear strip 26 is grasped and pulled by one wishing to open a bottle of sparkling wine, tear strip 26 separates from tether strip 28 because of a tearing of frangible webs 30 and 32 along the path of the grooves between the tether and tear strips. When helical tear strip 26 is removed, helical tether strip 28 remains to interconnect element 14 and collar 16 thus enabling element 14 to be released from bottle 12 without flying free.

Bottle 12 in FIGS. 1–4 is typical of bottles used to contain champagne and sparkling wines. Such bottles often have elongated, tapered, cylindrical necks containing a circumferential bulge or ridge 34 (known to the trade as a "finishing or bead ring") just below a lip 36 at the top of the bottle. Circumferential ridge 34 protrudes from the side of the bottle with sufficient radius to provide a means for restraining or impeding objects or devices, fastened above or below it, from moving up or down the neck of the bottle. In the past, such objects and devices have included woven wire baskets used to restrain champagne corks. In the present invention, circumferential ridge 34 is used to restrain retainer collar 16.

The tethered safety closure device 10 is preferably formed of a molded unitary piece of a suitable resilient substance. While polymerized plastic is a preferably resilient substance, other resilient substances are suitable as long as they are weak in shear when thin but strong in tension when thick. As used herein, "weak in shear when thin" means a substance that is manually tearable when used at the preselected thickness of the thin frangible webs connecting the tear and tether strips. "Strong in tension when thick" means that, at the thickness of the tether strip, the substance is strong enough to withstand longitudinal strain caused by sudden release of the cork from the bottle.

For purposes of this invention, a suitable resilient substance will be moldable. A suitable resilient substance will also have sufficient resiliency to allow tapered retainer collar 16 to stretch but not break as it is inserted over the neck of the bottle, including circumferential ridge 34. Following the expansion necessary to allow tapered retainer collar 16 to pass over circumferential ridge 34, a suitable material will still have sufficient resiliency to allow the collar to assume a shape that conforms generally to the contour of the outside of the bottle.

Element 14 is preferably comprised of a cup-like cap 20 and an inner plug 22. The cup-like cap 20 is comprised of a circular disk-like top portion 38 integrally molded with a hollow cylindrical side portion 40. The diameter of the cap's circular top portion 38 is greater than the diameter of top of the bottle neck. The inner circumference of the cap's hollow cylindrical side portion is greater than the outer circumference of the lip 36 at the top of bottle.

The top of cork's inner plug 22 is connected to the inside of the circular disk-like top portion 38 on cup-like cap 20. Inner plug 22 is preferably hollow having an outer circumferential wall surface 42 and an inner circumferential wall surface 44. In the preferred form of the present device, three thin radial ribs, spaced approximately 120° apart, protrude from the plug's top circumferential outer wall surface 42. One such radial rib 46 is shown in FIG. 1. The top portion of the radial ribs fuse with the inside surface of the circular disk-like top portion of cup-like cap 20. The ribs' inner sides extend down and are fused with the outer circumferential wall surface of inner plug 22. The area of the inner plug where the radial ribs are located is referred to herein as "the anterior portion" 52 of the inner plug 22.

The radial ribs are slightly shorter in length than the length of cylindrical side portion 40 of the cup-like cap 20. The ribs are of sufficient diameter to assure that the combination of inner plug plus radial ribs will have a diameter greater than the diameter of the opening at the top of the bottle. This is to allow the bottom of the radial ribs to come into contact with lip 36 at the top of bottle 12 thus preventing the anterior portion 52 of inner plug 22 from being pushed down into the neck of the bottle as a result of a downward force on cork cap 20.

While three ribs spaced approximately 120° apart are preferred, two ribs spaced approximately 180° apart, or four or more ribs spaced around the circumference of the inner plug, can be used as long as they function to prevent the anterior portion 52 of inner plug 22 from being pushed down into the neck of the bottle as a result of downward force on cork cap 20.

Cylindrical inner plug 22 has an outer diameter very slightly smaller than the diameters of the opening at the top of the bottle and the upper inner portions of the bottle neck. This allows the plug to fit tightly down into the neck of the bottle.

Just below the anterior portion 52 of inner plug 22, the plug contains a series of parallel annular ridges that protrude slightly from the plug's outer wall surface 42. The area of the inner plug where the annular ridges are located is referred to herein as "the annular ridge area" 54 of inner plug 22. The width and height of the annular ridges are approximately equal. The annular ridges extend down the outer wall 42 of the plug to a point approximately in line with the bottle's circumferential ridge 34 when the cork device 10 is in place in a bottle 12. When in place, the circumferential wall of the inner plug 22 supports the annular ridges against the inner wall of the bottle neck. As a result, the annular ridges grasp against the side of the bottle helping to seal its contents.

The outer wall surface 42 of inner plug 22 is smooth below annular ridge area 54. This area is referred to herein as "the smooth area" 56 of inner plug 22. When the tethered safety device is placed on a bottle, smooth area 56 will be in contact with the neck of the bottle near where the bottle's circumferential ridge 34 is located. The area of the inner plug that extends down below the smooth area 56 is referred to herein as "the tapered end portion" 58 of inner plug 22. As its name implies, the tapered end portion 58 of inner plug 22 is tapered so that its outer diameter is progressively less than the outer diameter of the rest of the plug. The thickness of the plug's wall also progressively diminishes in the tapered end portion 58 area. This narrowing and thinning at the bottom of the plug helps guide the plug down into the neck of the bottle.

An intercoupling means 18 joins element 14 and retainer collar 16. The intercoupling means is further comprised of a tabbed 24 tear strip 26 and a tether strip 28. Tab 24 on tear strip 26 contains a series of parallel protruding ridges that help prevent the tab from slipping when grasped by a person wishing to remove the tear strip from the present safety closure device.

Tear strip 26 and tether strip 28 are integrally formed in a helical configuration extending in a plurality of turns from element 14 to collar 16. The tear and tether strips do not begin at the same region on the cork or closure element, or do they end in the same region on the collar. They preferably begin or end separated from one another by an arc of approximately 60°. Such an arc permits separation of the tear strip from the tether strip without comprising the attachment of the tether strip to the cork or closure element and the collar.

The tear and tether strips extend in a plurality of turns from element 14 to collar 16. Any plurality of turns can be used in the present device as long as they allow the tether strip to permit removal of the cork while still adequately restraining the cork from flying free. A plurality of between two and four turns is preferred.

Tether strip 28 and tear strip 26 are interconnected by a pair of grooved frangible webs 30 and 32. The grooves between the tether strip and the tear strip, formed by the frangible webs, extend from cap 20 to collar 16. Tear strip 26 is removable by manually causing the webs to tear. Following removal of tear strip 26, tether strip 28 remains attached to cap 20 and collar 16 by means of a merging brought about by a gradual diminution of the depth of the groove separating the cap or collar material from the initial or final tether turns.

Frangible webs 30 and 32 separating tear strip 26 and tether strip 28 are comprised of the same resilient material used to make the molded tethered safety device 10. Frangible webs 30 and 32 are thinner than either tear strip 26 or tether strip 28. Frangible webs 30 and 32 can be of any preselected thickness that permits tear strip 26 to be manually torn away from tether strip 28, as long as at that thickness interconnecting means 18 is able to retain its integrity in an unopened state.

In addition to providing the means for connecting element 14 to retainer collar 16, intercoupling means 18 creates an integral tamperproof safety seal between element 14 and collar 16 because it unmistakably indicates by dismemberment if the product has been prematurely opened or tampered with anywhere between the bottler's facilities and the end user's location.

Retainer collar 16 is comprised of a hollow tapered cylinder that fits around the top outside portion of the bottle neck. The cylinder is tapered both in shape and in thickness. The tapered shape of retainer collar 16 generally mirrors the contour of the taper on the champagne or sparkling wine bottle. At its anterior end, where the tether strip merges with the collar material, retainer collar 16 contains a small circumferential ridge 60 that protrudes from the outer surface of the collar wall. Just below ridge 60, on the inner surface of the collar wall, the collar contains a circumferential groove 62. The shape and size of inner circumferential groove 62 generally mirrors and approximates the shape and size of circumferential ridge 34 on the outer surface of the champagne or sparkling wine bottle. Below the area of inner circumferential groove 62, the collar's cylindrical wall has maximum thickness. This maximum thickness extends down the collar approximately the longitudinal length of circumferential groove 62. When the tethered safety closure device 10 is installed on a champagne or sparkling wine bottle, the collar's circumferential groove 62 fits around the circumferential ridge 34 on the neck of the bottle thus holding the collar in place. Security of the collar on the bottle neck is assured because the collar wall's maximal thickness below groove 62 prevents upward movement of collar 16.

The length of retainer collar 16 is preferably greater than the combined lengths of element 14 and intercoupling means 18. Below the region of maximal thickness beneath circumferential groove 62, the collar's cylindrical wall gradually gets thinner. This tapering of the wall's thickness makes it easier to insert the tethered safety device on a champagne or sparkling wine bottle. This taper in thickness, along with the taper in shape, assures a tighter fit between collar 16 and the neck of bottle 12.

Because of the design of the tethered safety closure device and the resiliency of the material used to construct it, the unitary tethered safety closure device of the present invention can easily be inserted on bottles containing champagne or sparkling wine. The thinness at the bottom of the retaining collar facilitates placing the device on the wine bottle. The resiliency of the material used to make the tethered safety closure device allows it to expand and contract as necessary to fit securely in and around the neck of the bottle. This resiliency can be increased with heat if the properties of the material so warrant.

From the foregoing description and drawings it can be seen that the present invention provides a tethered safety cork device that utilizes a tether strip to restrain the cork to the neck of the bottle following its removal. This enables the cork to be released from champagne or sparkling wine bottles without flying free. Because the tethered safety cork device is a unitary device the need for secondary applications of additional restraining devices is eliminated. The tethered safety cork device also eliminates the need to manually restrain the champagne cork as it is removed from the bottle. In addition, the tethered safety cork device provides for a tamperproof safety seal that unmistakeably indicates when the seal has been tampered with. Thus the tethered safety cork device of the present invention provides a truly safe cork for bottles containing pressurized liquids such as champagne or sparkling wines.

Various modifications of the invention will become apparent to those skilled in the art from the foregoing description and drawings. Such modifications are intended to fall within the scope of the appended claims.

What is claimed is:

1. A molded tethered safety closure device comprising a closure element adapted to close the mouth of a bottle or the like by frictional engagement with the interior facing surface of the mouth, a retainer collar, and an intercoupling means connecting said collar to said closure element and forming a unitary structure with said closure element and said collar, said intercoupling means comprising a tabbed tear strip and a tether strip, said tear strip and said tether strip being integrally formed in a helical configuration extending in a plurality of turns from said closure element to said collar, said tether strip and said tear strip being joined by a pair of frangible webs of a preselected thickness to permit said tear strip to be manually removed, leaving said helical tether strip interconnecting said closure element and said retainer collar thus restraining said closure element from flying free of the bottle or the like when removed therefrom.

2. A molded tethered safety closure device according to claim 1 wherein said closure element, said retainer collar and said interconnecting means are composed of a resilient substance.

3. A molded tethered safety closure device according to claim 1 wherein said closure element, said retainer collar and said interconnecting means are integrally molded as a single unit.

4. A molded tethered safety closure device according to claim 1 wherein said closure element is comprised of an outer cup-like portion that extends over and around the opening at the top of the bottle or the like, and an inner ribbed plug portion that fits in the mouth of the bottle or the like to form a seal therewith.

5. A molded tethered safety closure device according to claim 1 wherein said retainer collar comprises a tapered cylindrical structure having a circumferential groove adapted for engaging a corresponding circumferential ridge on the outside of the bottle or the like.

6. A molded tethered safety closure device according to claim 1 wherein said preselected thickness of said frangible webs is less than the thickness of said tether and tear strips.

7. A molded tethered safety closure device according to claim 2 wherein said resilient substance is plastic.

8. A molded tethered safety closure device according to claim 4 wherein said outer cup-like portion of said closure element is comprised of a circular disk-like top portion integrally molded with a hollow cylindrical side portion.

9. A molded tethered safety closure device according to claim 4 wherein said inner plug is composed of an anterior portion, an annular ridge portion, a smooth portion and a tapered end portion.

* * * * *

UNITED STATES PATENT AND TRADEMARK OFFICE

CERTIFICATE OF CORRECTION

PATENT NO. : 4,474,302

DATED : October 2, 1984

INVENTOR(S) : James R. Goldberg and Albert J. Kurtz

It is certified that error appears in the above-identified patent and that said Letters Patent is hereby corrected as shown below:

Column 7, lines 10-11, delete "in a plurality of turns".

Signed and Sealed this

*Nineteenth* Day of *March 1985*

[SEAL]

*Attest:*

DONALD J. QUIGG

*Attesting Officer*

*Acting Commissioner of Patents and Trademarks*